US005125787A

United States Patent [19]

Ball et al.

[11] Patent Number: 5,125,787

[45] Date of Patent: Jun. 30, 1992

[54] BACKHOE BOOM CONSTRUCTION

[75] Inventors: Garry L. Ball, Lancaster, Pa.; Russell I. Johnson, Leonard, Mich.; Daniel D. Radke, Antwerp, Belgium

[73] Assignee: Ford New Holland, Inc., New Holland, Pa.

[21] Appl. No.: 658,617

[22] Filed: Feb. 21, 1991

Related U.S. Application Data

[62] Division of Ser. No. 440,936, Nov. 22, 1989, Pat. No. 4,997,333.

[51] Int. Cl.[5] ..... E02F 3/38

[52] U.S. Cl. ..... 414/722; 52/731; 29/897.2; 212/266

[58] Field of Search ..... 414/694, 722; 212/266; 296/203, 204, 205, 209; 52/731, 720, 117, 116; 29/897.2

[56] References Cited

U.S. PATENT DOCUMENTS

| | | | |
|---|---|---|---|
| 3,190,410 | 6/1965 | Mostad | 52/731 |
| 3,902,295 | 9/1975 | Yancey . | |
| 4,159,796 | 7/1979 | Braithwaite . | |
| 4,161,369 | 7/1979 | Moreno . | |
| 4,392,314 | 7/1983 | Albrecht et al. | 414/694 X |
| 4,428,173 | 1/1984 | Knell . | |
| 4,666,360 | 5/1987 | Harms et al. | 414/722 X |

FOREIGN PATENT DOCUMENTS

| | | | |
|---|---|---|---|
| 942414 | 5/1956 | Fed. Rep. of Germany | 212/266 |
| 222220 | 12/1983 | Japan . | |

*Primary Examiner*—Robert J. Spar
*Assistant Examiner*—Donald W. Underwood
*Attorney, Agent, or Firm*—Larry W. Miller; Frank A. Seemar

[57] ABSTRACT

A tractor-loader-backhoe is disclosed wherein the loader mechanism is mounted on the frame of the prime mover by a tapered pivot pin having a fastener extending entirely through the axis of the pivot pin to effect a clamping load operable to seat the tapered pivoted in the conical hub affixed to the frame of the prime mover to assure a firm fastening of the loader mechanism on the prime mover. The backhoe mechanism is provided with a transport lock remotely accuatable from the operator's cab mounted on the prime mover and incorporating a locking pin having a concentric spring mounted thereon to urge the pin out of engagement with the frame whenever the transport lock is disengaged to permit operation of the backhoe mechanism. The boom and dipper members of the backhoe mechanism are constructed from a pair of opposing C-shaped channels having inwardly directed legs centrally located within the boom and dipper members. The opposingly facing channel members form a longitudinally extending seam to facilitate welding of the two channel members constructing the boom and dipper members.

6 Claims, 8 Drawing Sheets

10
11
12
13
14
20
21
22
23
25
27
28
30
32
33
34
36
40
41
42
43
45
46
47
48
49
50
52
53
55
56
57
58
G
2
5
7

BACKHOE BOOM CONSTRUCTION

CROSS-REFERENCE TO RELATED APPLICATIONS

This application is a divisional of U.S. Pat. application Ser. No. 440,936, filed Nov. 22, 1989, now issued as U.S. Pat. No. 4997,333 on Mar. 5, 1991.

BACKGROUND OF THE INVENTION

This invention relates generally to construction vehicles commonly referred to as tractor-loader-backhoes and, more particularly, to a tapered pivot pin mount for the loader mechanism, an improved transport lock for the backhoe, and an improved backhoe boom construction.

Loader mechanisms are pivotally mounted to the frame of a prime mover to be operable forwardly of the tractor-loader-backhoe, commonly referred to as a TLB. This pivotal mounting of the loader mechanism is typically accomplished by use of a tapered pivot pin that would typically be supported in a conical hub forming part of the frame of the prime mover. The tapered pivot pin would be fastened to the frame of the prime mover by a short bolt threaded into the pin to seat the tapered pin into the conical hub. The clamp load exerted by this fastener does not consistently seat the tapered pin into the conical hub permitting the pin to loosen, and, as a result, induce failure to the pivot pin, thereby destroying the pivotal mounting of the loader mechanism to the prime mover.

Backhoe mechanisms are pivotally mounted to the rear of the frame of the prime mover to permit swinging movement about a generally vertical axis, as well as articulated movement of the boom assembly itself within a vertical plane. The transportation of the TLB from one job site to another requires a fixing of the backhoe boom assembly in a rearwardly extending position generally aligned with the center line of the prime mover, although the articulated movement of the boom assembly would be compacted to limit the overall length of the machine. To fix the boom assembly into this transport position, the TLB would incorporate a transport lock utilizing a shear plate to fit within a slot on the portion of the prime mover frame carrying the generally vertical pivot axis for the backhoe boom assembly. It has been found on occasion that the shear plate would not properly operate resulting in a failure of the swing post casting forming a portion of the prime mover frame, which is a very expensive and difficult part to replace.

Construction of the boom assembly in prior art backhoe mechanisms typically utilized a box beam construction or perhaps C-channel members which are butt welded to form the boom member and dipper member portions of the boom assembly. Because of the heavy bending and torsional loads induced into the boom assembly during operation of the backhoe, it has been necessary to construct the boom member and dipper member with substantially sized members having relatively heavy wall thicknesses to withstand the operating loads induced therein. Furthermore, the butt welding of members requires finely cut edges to assure a proper welding therebetween. Such construction results in a greater expense due to the care of maintaining weldable edges. It would be desirable to provide a method of constructing the boom and dipper members of a backhoe mechanism which is lighter, more rapidly formed and more conducive to welding, without sacrificing structural strength or integrity.

SUMMARY OF THE INVENTION

It is an object of this invention to overcome the aforementioned disadvantages of the prior art by providing a tapered pivot pin mounting for the loader mechanism of a tractor-loader-backhoe which will effect proper seating in the conical hub in which the pivot pin is mounted on the frame of the prime mover.

It is another object of this invention to provide a tapered pin mount for the loader mechanism of a tractor-loader-backhoe that will provide sufficient clamping load to seat the tapered pin into the conical hub.

It is a feature of this invention that the pivot pin is provided with an axially aligned hole drilled through the entire length of the pivot pin.

It is another feature of this invention that the tapered pin is mounted on the frame of the prime mover by a long fastener extending along the entire length of the tapered pivot pin clamped the tapered pin into the conical hub in which it is seated.

It is an advantage of this invention that the long fastener extending through the entire length of the tapered pivot pin provides a high clamp load that will seat the taper lock into the frame of the prime mover.

It is another advantage of this invention that the tapered pivot pin mounting the loader mechanism on the prime mover will properly seat into the conical hub from which it is supported on the prime mover frame.

It is still another object of this invention to provide a tapered pivot pin mounting for the loader mechanism of a tractor-loader-backhoe which is durable in construction, carefree of maintenance, inexpensive of manufacture, facile in assemblage, and simple and effective in use.

It is still another object of this invention to overcome the aforementioned disadvantages of the prior art by providing a transport lock for a backhoe mechanism incorporating a spring loaded locking pin which withdraws from the main frame of the prime mover when the transport lock is disengaged.

It is yet another object of this invention to provide a transport lock for the backhoe mechanism of a tractor-loader-backhoe utilizing a locking pin insertable through aligned holes in the boom assembly mounting member and in the prime mover main frame to fix the boom assembly into a transport position.

It is still another feature of this invention that the transport lock is remotely operable from the operator's cab mounted on the prime mover.

It is yet another feature of this invention that the transport lock incorporates a spring concentrically mounted around the locking pin to urge the locking pin out of engagement with the frame to assure release of the locking pin when the transport lock is deactivated.

It is still another advantage of this invention that the spring loader locking pin disengages the main frame of the prime mover when the transport lock is disengaged to effect operation of the backhoe mechanism.

It is yet another object of this invention to provide a transport lock for a backhoe mechanism to retain the boom assembly into a transport position, which is durable in construction, inexpensive of manufacture, carefree of maintenance, facile in assemblage, and simple and effective in use.

It is a further object of this invention to overcome the aforementioned disadvantages of the prior art by providing a backhoe boom member constructed by a pair of C-shaped channels having inwardly directing legs welded together to form the boom member and dipper member of the boom assembly.

It is yet another feature of this invention that the formed C-shaped channels provide a grooved seam along the center line of the structural member to facilitate welding.

It is yet another advantage of this invention that the ends of the boom and dipper members are closed with a shear panel forming a closed box section.

It is a further advantage of this invention that the inwardly directed legs centrally aligned within the interior of the boom and dipper members provide increased torque carrying capabilities.

It is yet another feature of this invention that the boom and dipper members can be constructed with less material, resulting in a less expensive and more easily manufactured boom assembly.

It is still another feature of this invention that the material edges of the boom member are positioned along the interior of the member.

It is still a further advantage of this invention that the blank from which the boom member is formed can be flame cut with rough edges.

It is still a further object of this invention to provide a method of construction for the boom member and dipper member of a backhoe assembly wherein the blanks can be roughly cut and positioned in the interior of the member.

It is yet a further object of this invention to provide boom and dipper members of a backhoe mechanism which are durable in construction, inexpensive of manufacture, carefree of maintenance, facile in assemblage, and simple and effective in use.

These and other objects, features, and advantages are accomplished according to the instant invention by providing a tractor-loader-backhoe in which the loader mechanism is mounted on the frame of the prime mover by a tapered pivot pin having a fastener extending entirely through the axis of the pivot pin to effect a clamping load operable to seat the tapered pivoted in the conical hub affixed to the frame of the prime mover to assure a firm fastening of the loader mechanism on the prime mover. The backhoe mechanism is provided with a transport lock remotely actuatable from the operator's cab mounted on the prime mover and incorporating a locking pin having a concentric spring mounted thereon to urge the pin out of engagement with the frame whenever the transport lock is disengaged to permit operation of the backhoe mechanism. The boom and dipper members of the backhoe mechanism are constructed from a pair of opposing C-shaped channels having inwardly directed legs centrally located within the boom and dipper members. The opposingly facing channel members form a longitudinally extending seam to facilitate welding of the two channel members constructing the boom and dipper members.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
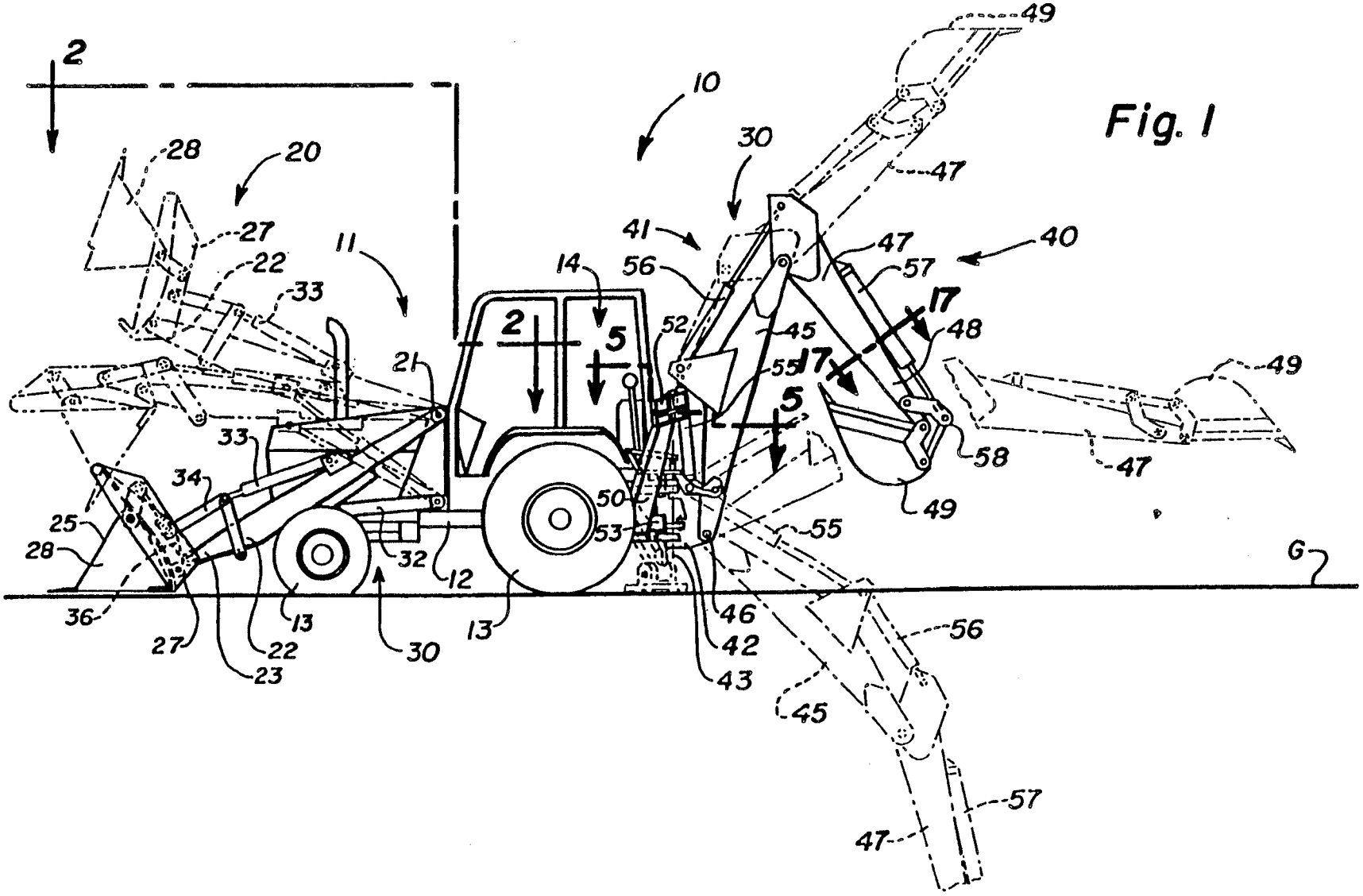
FIG. 1 is a side elevational view of a tractor-loader-backhoe incorporating the principles of the instant invention, the respective movements of the loader mechanism, articulated working tool, outrigger stabilizers, and backhoe mechanism being shown in phantom.

Referring now to the drawings and, particularly, to FIG. 1, a side elevational view of a tractor-loader-backhoe, commonly referred to as a TLB, incorporating the principles of the instant invention can be seen. Any left and right references are used as a matter of convenience and are determined by standing at the rear of the machine, facing the forward end, the direction of travel. The tractor-loader-backhoe 10 includes a prime mover 11 having a frame 12 provided with wheels 13 to permit mobile movement of the prime mover 11 over the ground G. The prime mover 11 is also provided with an operator's station 14 in which various operative controls are conveniently accessible to permit the operator to control the operable functions of the tractor-loader-backhoe 10.

Figure 2:
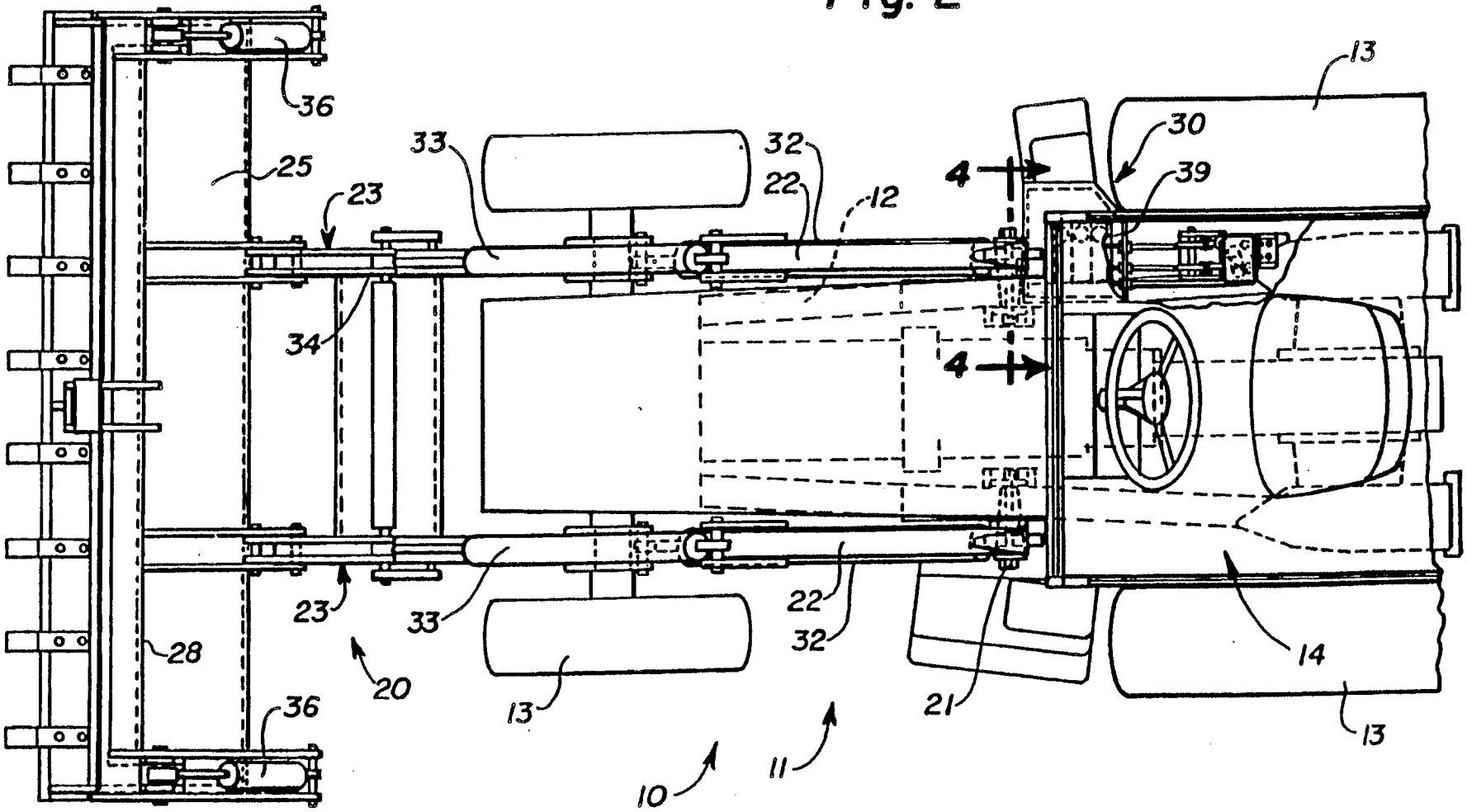
FIG. 2 is an enlarged top elevational view of the forward portion of the tractor-loader-backhoe shown in FIG. 1, corresponding to lines 2—2 of FIG. 1, to show the loader mechanism in greater detail.

As is best seen in FIGS. 1 and 2, the TLB 10 has a loader mechanism 20 mounted forwardly thereof for the handling of material. The loader mechanism 20 includes a pair of fore and aft extending loader arms 22 pivotally connected to the frame 12 for vertical movement, as shown in phantom in FIG. 1, about a generally horizontally extending axis 21, and a working tool 25 pivotally connected at the distal end 23 of the loader arms 22 for pivotal movement relative thereto, as is also shown in phantom in FIG. 1. The working tool 25, shown in FIGS. 1 and 2 as a bucket, can be capable of independent articulated movement, such as shown in the clam shell bucket in phantom in FIG. 1. Such buckets would include at least a base member 27 affixed to the loader arms 22 and a movable member 28 pivotally supported from the base member 27 to be movable relative thereto.

The prime mover 11 is provided with a conventional power source (not shown) including a hydraulic system 30 providing a source of hydraulic fluid under pressure to various hydraulic components carried by tractor-loader-backhoe 10. The hydraulic system 30 includes a pair of hydraulic cylinders 32 interconnecting the frame 12 of the prime mover 11 and the loader arms 22 to power the pivotal movement thereof about the horizontal axis 21. Similarly, a pair of co-acting hydraulic cylinders 33 interconnecting the loader arms 22 and a linkage 34 operably connected to the working tool 25 effects pivotal movement of the working tool 25 relative to the loader arms 22.

For those machines 10 incorporating an articulated working tool 25, the hydraulic system 30 would also include a pair of transversely disposed co-acting hydraulic cylinders 36 interconnecting the base member 27 and the movable member 28 to effect articulation of the movable member 28 relative to the base member 27. Each hydraulic cylinder 32, 33, 36 would be provided with conventional plumbing connections (not shown) to provide hydraulic fluid under pressure thereto through a control valve 39 supported on the frame 12 adjacent the operator's compartment 14 to control the direction of flow of hydraulic fluid through the hydraulic system 30 in a conventional manner.

Figure 3:
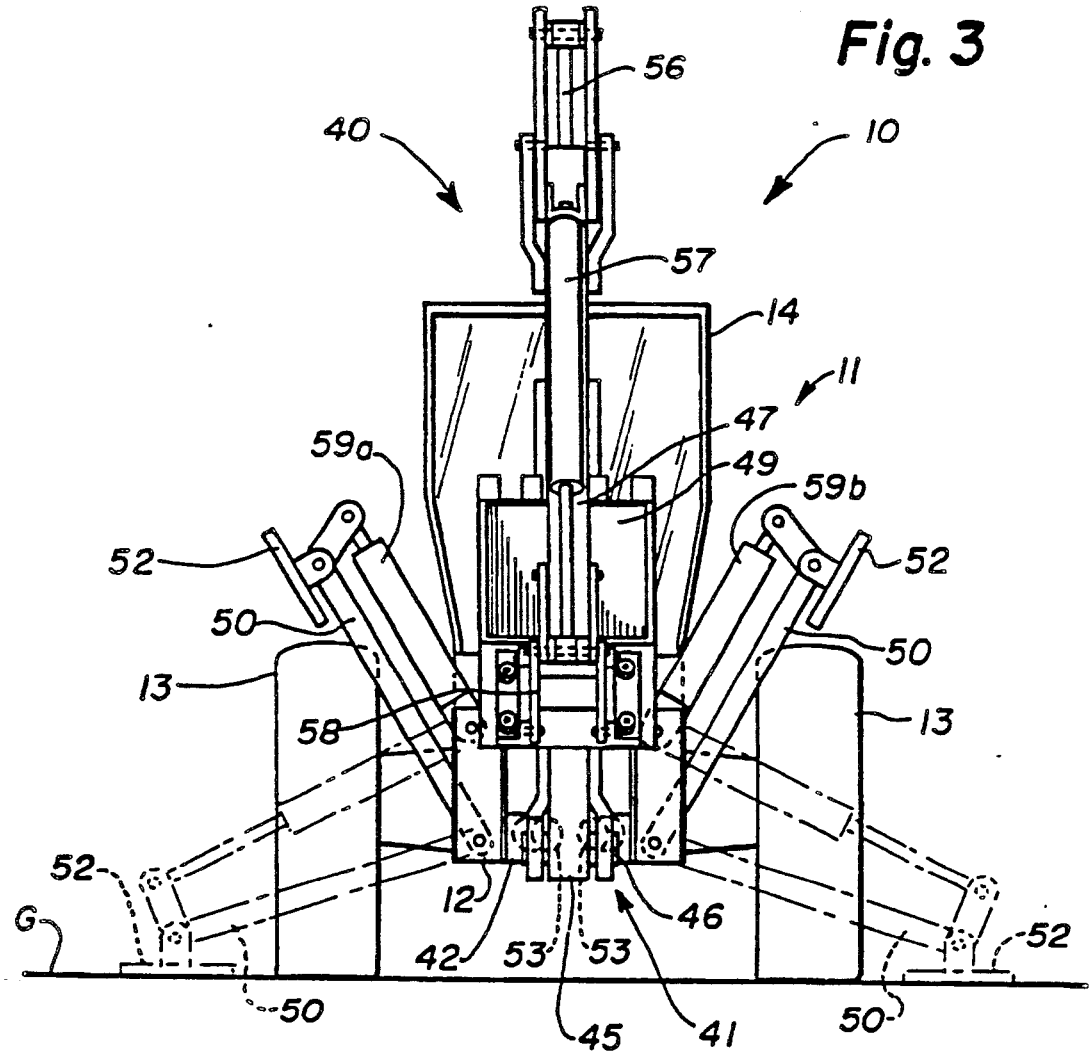
FIG. 3 is a rear elevational view of the tractor-loader-backhoe seen in FIG. 1, depicting the backhoe mechanism mounted thereon in a transport position, the pivotal movement of the outrigger stabilizers being shown in phantom.

Referring now to FIGS. 1 and 3, it can be seen that the tractor-loader-backhoe 10 is also provided with a backhoe mechanism 40 mounted at the rearward end of the prime mover 11 for pivotable operation in a known manner. The backhoe mechanism 40 includes a boom assembly 41 including a mounting member 42 pivotally connected to the frame 12 to permit pivotal movement of the boom assembly 41 about a generally vertically extending axis 43. The boom assembly 41 also includes a boom member 45 pivotally connected to the mounting member 42 for generally vertical movement about a horizontally extending axis 46 and a dipper member 47 pivotally connected to the boom member 45 for articulated movement relative thereto a common vertical plane therewith. The boom assembly 41 also includes a digging bucket 49 pivotally connected to the distal end 48 of the dipper member 47 for articulated movement relative thereto in a conventional manner.

When the backhoe mechanism 40 is being operated, a means for stabilizing the motion of the prime mover 11, i.e., to restrain rolling motion of the wheels 13, is customarily provided. The machine 10 is provided with a pair of laterally extending outrigger stabilizers 50 pivotally connected to the frame 12 of the prime mover 11 for movement between an elevated transport position, shown in solid lines in FIG. 3, and a ground engaging position, shown in phantom in FIG. 3. Each outrigger stabilizer 50 is provided with a ground engaging shoe 52 which can be constructed in a number of configurations to complement the surface of the ground G to be engaged. By sufficient downward pressure of the loader mechanism 20 and the outrigger stabilizers 50, the prime mover 11 can be elevated to the extent that the wheels 13 are not engaged with the ground G during operation of the backhoe mechanism 40.

To power the operation of the backhoe mechansim 40 and the outrigger stabilizers 50, the hydraulic system 30 is also provided with swing cylinders 53 interconnecting the frame 12 of the prime mover 11 and the mounting member 42 to effect pivotal movement thereof in a generally horizontal plane about the vertical axis 43. The hydraulic system 30 also includes a boom cylinder 55 interconnecting the mounting member 42 and the boom member 45 to power the vertical movement of the boom member 45, dipper member 47, and bucket 49 about the horizontal axis 46.

The hydraulic system 30 also includes a dipper cylinder 56 interconnecting the boom member 45 and the dipper member 47, as well as a bucket cylinder 57 interconnecting the dipper member 47 and the bucket 49 through a conventional connecting linkage 58. Each outrigger stabilizer 50 is provided with an individually operable cylinder **59*a*, 59*b* to permit level stabilization of the prime mover 11 on sloping ground, as is conventionally known. Each hydraulic cylinder 53, 55, 56, 57, 59*a*, and 59*b* are independently operable through a conventional control mechanism (not shown) located in the operator's compartment 14**.

Customarily, the backhoe mechanism 40 is operable, through appropriate manipulation of the hydraulic system 30, to dig at an elevation lower than the surface of the ground G in which the prime mover 11 is positioned, as shown in phantom in FIG. 1. The backhoe mechanism 40 can be articulated into a compact transport position shown in FIGS. 1 and 3, centrally located relative to the line of travel of the prime mover 11, for transport thereof over the ground G. When the backhoe mechanism 40 is placed into this transport position, the boom cylinder 55 is completely collapsed to a fully retracted position, while the dipper cylinder 56 and the bucket cylinder 57 are extended. In addition, the transportation of the machine 10 over the ground C requires a raising of the outrigger stabilizers 50 to the transport position which results in a complete retraction of the associated hydraulic cylinders **59*a*, 59*b***.

Figure 4:
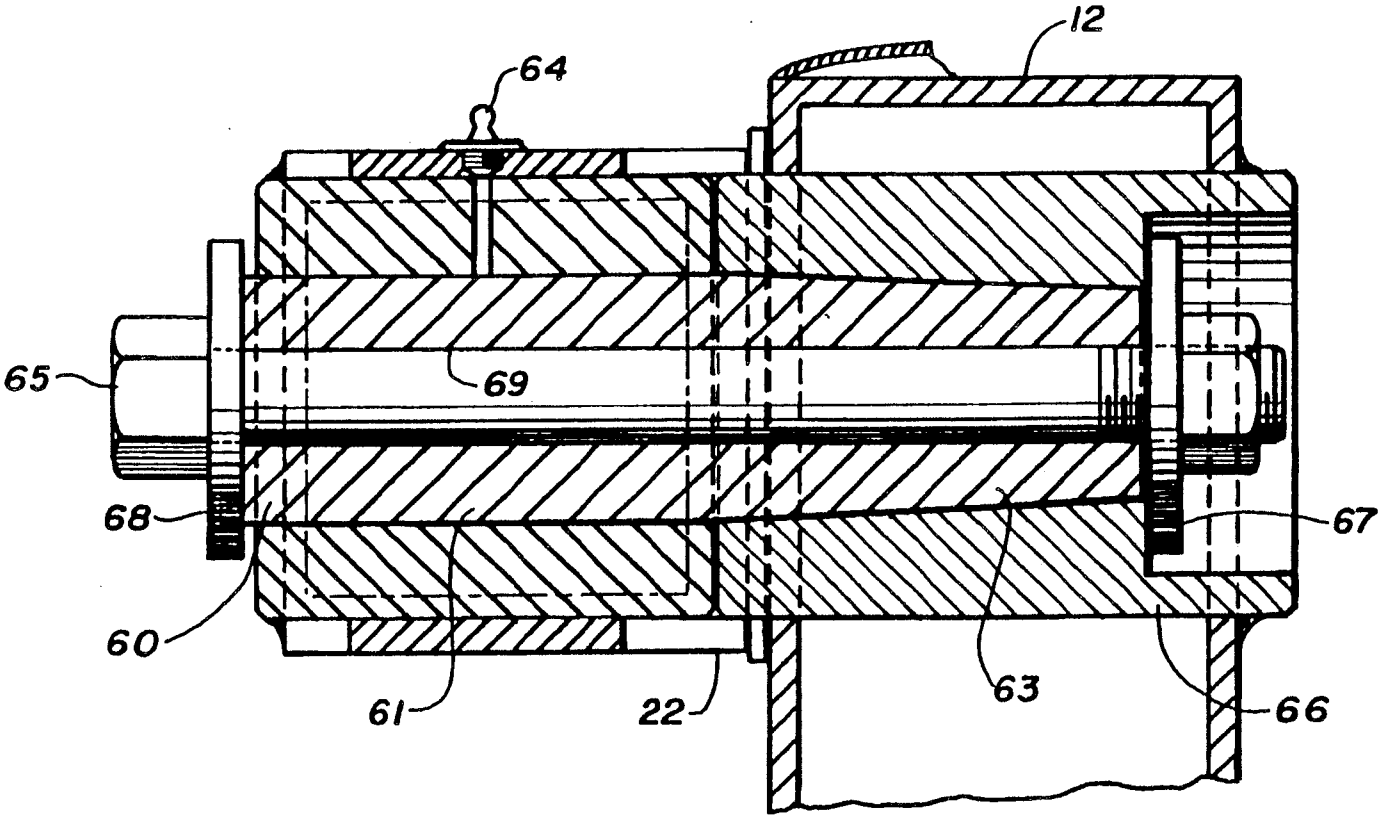
FIG. 4 is an enlarged cross-sectional view corresponding to lines 4—4 of FIG. 2, depicting the details of the tapered pivoted pin mounting for the loader mechanisms.

Referring now to FIG. 4, an enlarged cross-sectional detail view of the pivotal mounting of loader mechanism 20 on the frame 12 the prime mover 11 can best be seen. The pivot pin 60 has a straight portion 61 and a tapered portion 63. The loader arm 22 is pivotally mounted on the straight portion 61 of the pivot pin 60 and is equipped with a grease zerk 64 to permit introduction of lubricant between the loader arm 22 and the pivot pin 60 to facilitate pivotal movement therebetween. The tapered portion 63 is seated within a conical hub 66 fixed to the frame 12 of the prime mover 11. The interface of the tapered surfaces on the tapered portion 63 of the pivot pin 60 and the conical hub 66 provides a known means for locking the pivot pin 60 into the frame 12 of the prime mover 11 for proper support of the loader mechanism 20.

To assure proper seating of the tapered portion 63 into the conical hub 66, a fastener 65 is inserted entirely through an opening 69 axially extending through the center of the pivot pin 60. A washer 67 seated against the conical hub 66 and a washer 68 seated against the opposing end of the straight portion 61 of the pivot pin 60 permits the fastener 65 to draw the pivot pin 60 firmly into the conical hub 66, providing a high clamping load that will assure complete seating of the taper lock.

Figure 5:
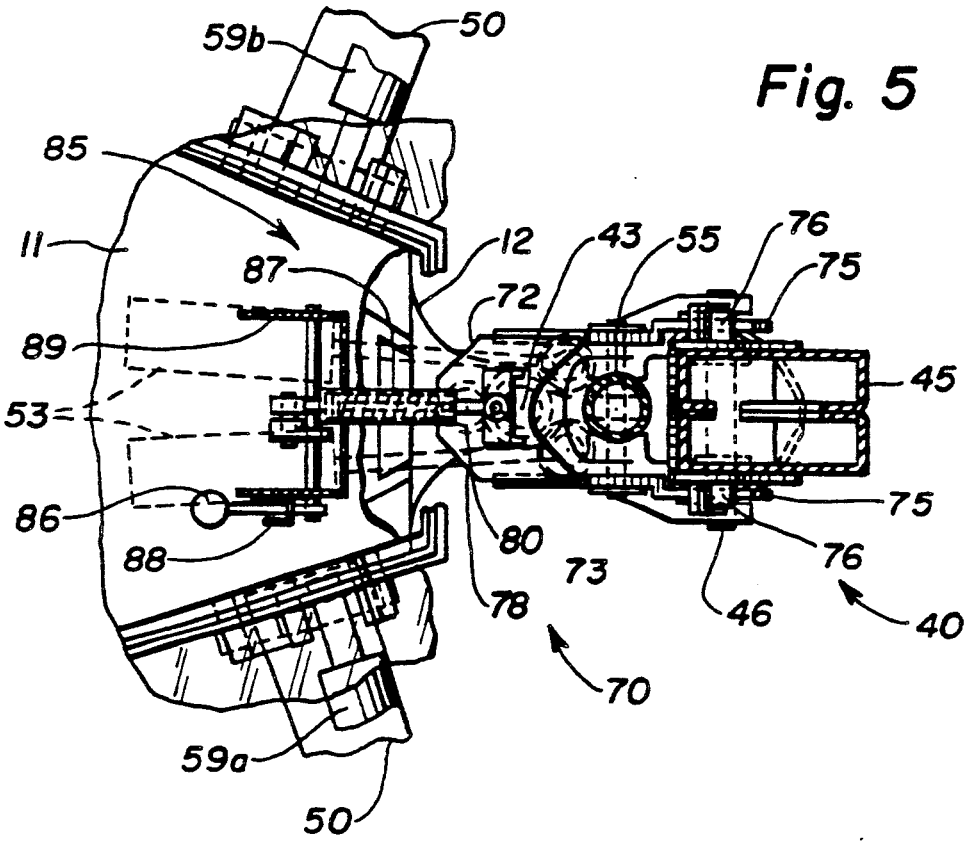
FIG. 5 is an enlarged top plan view of the transport lock for the backhoe mechanism located at the rear of the prime mover taken along lines 5—5 of FIG. 1.
Figure 6:
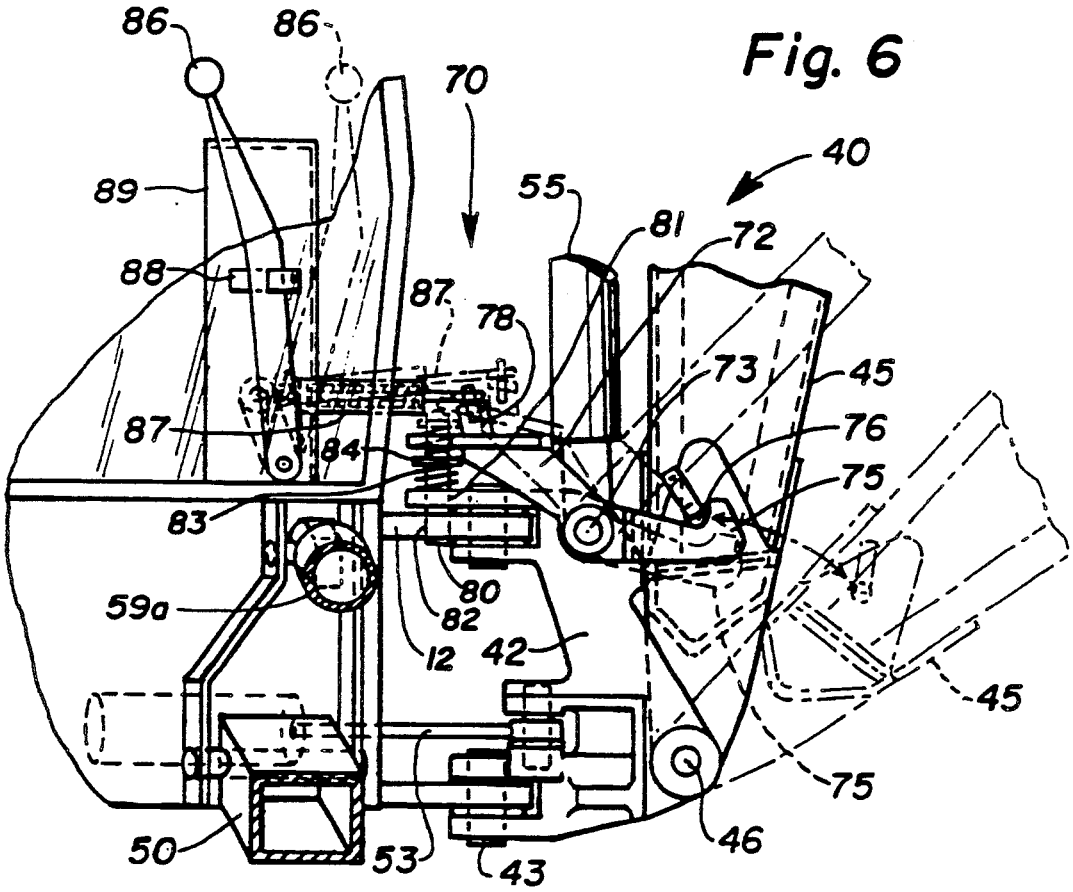
FIG. 6 is a side elevational view of the transport lock shown in FIG. 5, the movements of the transport lock and the backhoe boom member being shown in phantom.
Figure 7:
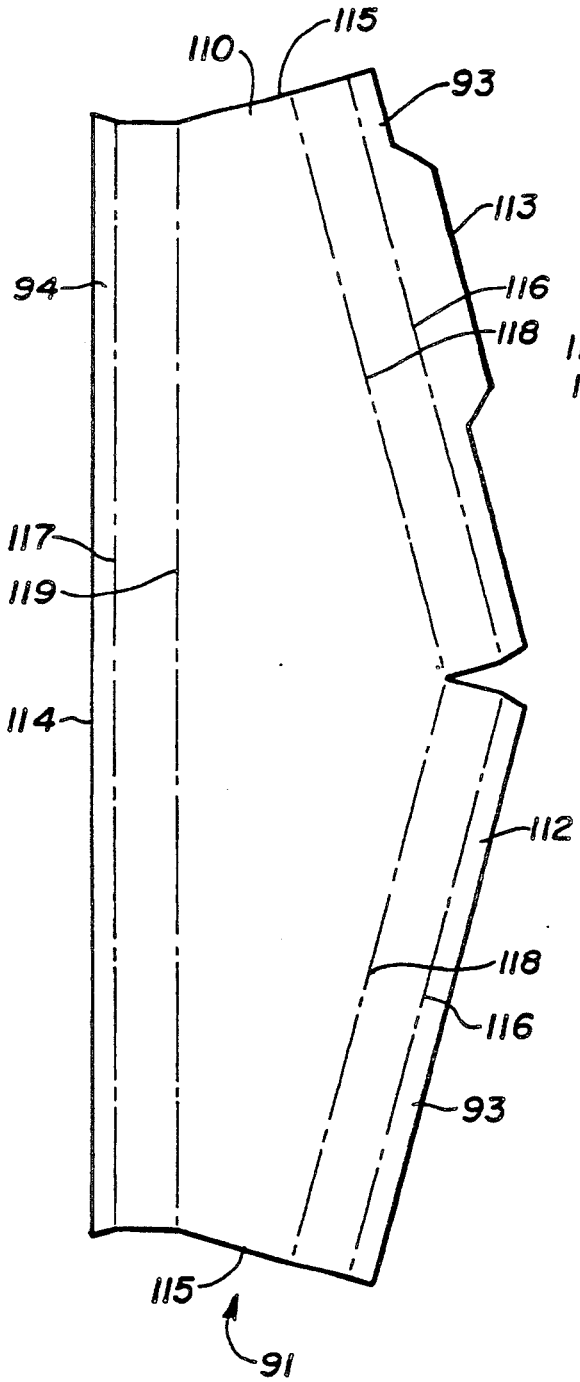
FIGS. 7 and 8 are schematic plan views of the blanks used to construct the opposing halves of the boom member forming part of the backhoe mechanism shown pivotally mounted to the rear of the prime mover in FIGS. 1 and 3, to depict the initial steps in the method of manufacturing the boom member.
Figure 8:
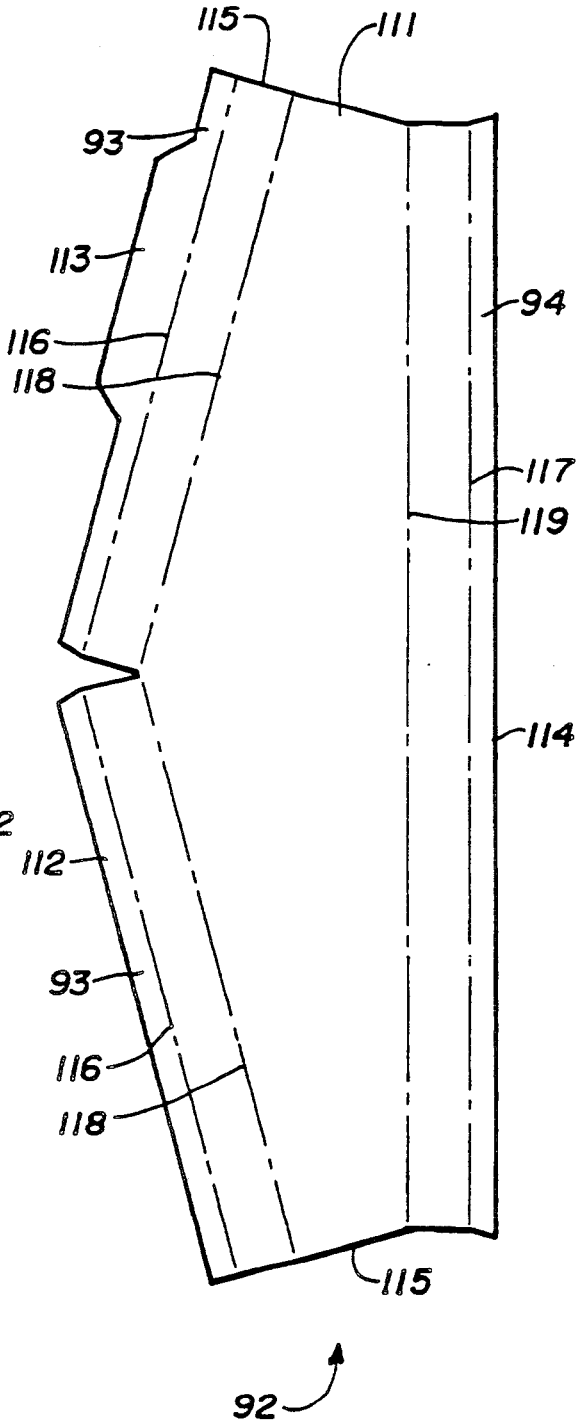

Referring now to FIGS. 5 and 6, the details of the transport lock 70 utilized with the backhoe mechanism 40 can best be seen. The transport lock 70 includes a plate member 72 pivotally connected to the mounting member 42 for pivotal movement about a generally horizontally extending axis 73. The plate member 72 is provided with a pair of transversely spaced integral hook members 75 extending rearwardly from the horizontal axis 73 for engagement with pins 76 protruding transversely outwardly from the boom member 45 when the boom assembly 41 is placed into the transport position. The plate member 72 is also provided with an actuation porition 78 extending forwardly from the horizontal axis 73, the actuation portion 78 and the hook member 75 being integrally formed and pivotable in unison about the horizontal axis 73.

The transport lock 70 also includes a locking pin 80 positioned within and is extendable through an opening 81 in the mounting member 42 and retained in position by the actuation portion 78 of the plate 72 which is in engagement with, but not attached to, the locking pin 80. The locking pin 80 is also insertable through an alignable hole 82 in the frame 12 of the prime mover 11 supporting the generally vertical axis 43 about which the backhoe mechanism 40 is mounted. The locking pin 80 is also provided with a concentric spring 83 mounted on the pin 80 between the mounting member 42 and the head 84 of the pin 80.

An actuation linkage 85 interconnects between the actuation portion 78 of the plate member 72 and a control lever 86 positioned within the operator's cab 14. The actuation linkage 85 also includes an extensible actuator link 87 incorporating an internal spring member to permit lost motion of the actuator link if the holes 81, 82 are not properly aligned, as will be described in greater detail below. A retention clip 88 affixed to the control panel 89 within the operator's compartment 14 retains the control lever 86 in a locked position corresponding to an actuation of the transport lock 70.

In operation, the transport lock 70 is engaged through manipulation of the control lever 86 to the locked position retained by the retention clip 88. Such motion of the control lever 86 pulls rearwardly on the actuator linkage 87, which in turn effects a downward pivotal motion of the actuation portion 78 of the plate 72 to force the locking pin 80 toward engagement with the hole 82 in the frame 12 of the prime mover 11. If the holes 81, 82 are not properly aligned, the extensible motion of the actuator link 87 permits a biasing force to be exerted on the locking pin 80 to force the pin 80 through the holes 81, 82 when proper alignment is attained through a slight manipulation of the movement of the backhoe mechanism 40 of the vertical axis 43.

The downward movement of the locking pin 80 through the holes 81, 82 prevents further relative movement between the mounting member 72 and the frame 12 and effects a compression of the spring 83 between the head 84 and the mounting member 42. The pivotal movement of the plate member 72 to push the locking pin 80 into engagement with the frame 12 also effects an upward movement of the hook members 75 into engagement with the pins 76 on the boom member 45, once the boom member 45 has been raised into the transport position, thereby preventing any further rotational movement of the boom member 45 about its horizontal pivot axis 46.

If the boom assembly 41 is not in the transport position when the transport lock 70 is actuated, the engagement of the boom pins 76 with the curved periphery of the hook members 75 forces a counter rotation of the plate member 72 about the horizontal axis 73, causing an extension of the actuator link 87 and a brief raising of the locking pin 80 until the boom pins 76 move into a locking engagement with the hook members 75 to restrict further movement of the boom assembly 41 about its pivot axis 46 until the transport lock 70 is disengaged. Accordingly, actuation of the transport lock 70 operatively locks the backhoe mechanism 40 from further swinging movement about either the vertical axis 43 or the horizontal axis 46.

A release of the control lever 86 from the retention clip 88 effects an opposite pivotal movement of the plate member 72, dropping the hook members 75 out of engagement with the boom pins 76 and permitting the locking pin 80 to be released from engagement with the frame 12 due to the biasing force exerted on the locking pin 80 by the compressed spring 83. Accordingly, a disengagement of the transport lock 70 frees the backhoe mechanism 40 for swinging movement about the vertical axis 43 and for a pivotal movement of the boom member 45 and attached members 47, 49 about the horizontal axis 46.

Referring now to FIGS. 1, 3, and 7–17, the construction of the boom member 45 and dipper member 47 can best be seen. While the dipper member 47 is constructed in substantially the same manner as will be described below using differently shaped blanks, only the method of constructing the boom member 45 will be described in detail. The boom member 45 is formed by a pair of channel members 91, 92 having a C-shaped cross-sectional configuration. Each channel member 91, 92 forms half of the boom member 45 and is affixed to the other channel members in an opposing facing configuration by welding. Each channel member 91, 92 includes an upper leg 93 and a lower leg 94 directed inwardly toward each other.

The positioning of the channel members 91, 92 in oppositely facing orientation, forms a seam 95 running longitudinally along the length of the boom member 45. This seam 95 provides a groove for more efficiently welding the two channel members 91, 92 longitudinally along the length of the boom member 45. The welding of the two channel members 91, 92 along the seam 95 positions the upper and lower legs 93, 94 in an inwardly directed orientation to provide structure resisting torsional and bending forces exerted on the boom member 45 during operation of the backhoe mechanism 40.

The dipper member 47 is also constructed from two opposing channel member 96, 97 with upper and lower inwardly directed legs 98, 99, respectively, which when cojoined forms a longitudinally running seam 100 for the effective welding of the two channels 96, 97 to form the dipper member 47. As is best seen in FIG. 1, the boom member 45 is formed with a thicker cross section at the central portion thereof to resist the bending moments induced by the mounting of the hydraulic cylinders 55, 56. Since the bucket cylinder 57 extends substantially along the entire length of the dipper member 47, the thickest portion of the dipper member 47 is located adjacent the boom member 45 to resist the bending forces exerted thereon during operation of the backhoe mechanism 40.

The channels 91, 92 forming the opposite halves of the boom member 45 are constructed narrow ends and a substantially thicker central portion. The utilization of the inwardly directed legs 93, 94, 98, 99 permits the depth of the legs 93, 94, 98, 99 to be varied as desired to withstand torsional forces induced during operation of the backhoe mechanism 40.

The ends of the boom member 45 and the dipper member 47 can be closed with shear panels 102 forming part of an end cap 124 to form a closed box section with respect to each member 45, 47. The shear panels 102 are oriented transversely to the channel members and provide excellent torque carrying capabilities when used in conjunction with the two oppositely faced channel members 91, 92 and 96, 97, respectively. The boom and dipper members 45, 47 constructed as described above provide a relatively lightweight and inexpensive manufacture without sacrificing the required bending moment and torque carrying properties of the members 45, 47. Furthermore, the welding of the two channel members 91, 92 and 96, 97 along the longitudinal seams 95, 100, respectively, results in a load cancelling effect which produces a low vertical bending moment, which in turn keeps the bending stresses at a minimum.

Referring now to FIGS. 7–16, the method of constructing the boom member 45 can best be seen. The fabrication process begins with a pair of blanks 110, 111 cut into the configuration seen in FIGS. 7 and 8. Since the edges 112, 113 and 114 will eventually become internally positioned, the blanks 110, 111 can be cut from a larger piece of steel by a less precise manner of cutting, such as a flame cutter, rather than using a laser cut or a shear cut. One skilled in the art will realize that flame cutting produces a rough edge 112, 113 and 114 but the final configuration of the boom member 45 positions these edges 112, 113 and 114 internally without utilization thereof for welding which would not require a finely cut edge, such as is typically needed for welding. Likewise, the end edges 115 will be enclosed within the end caps 124 and need not have a finely cut edge. One skilled in the art will readily realize that the blanks 110, 111 can be cut in the desired manner to form in the final configuration a variable length leg 93 as is described above.

Figure 9:
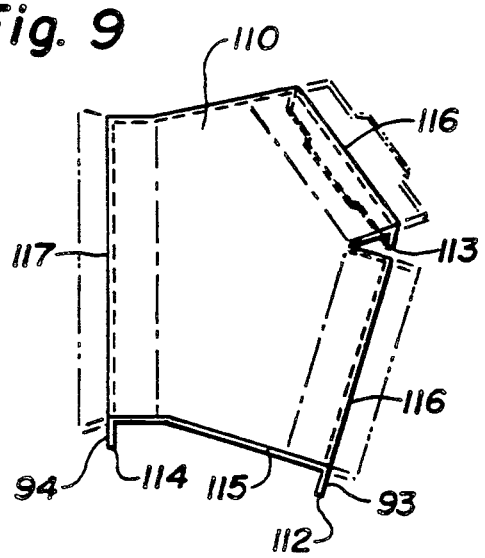
FIGS. 9 and 10 are perspective schematic views of the blanks shown in FIGS. 7 and 8, depicting a successive step in the method of manufacturing the boom member.
Figure 10:
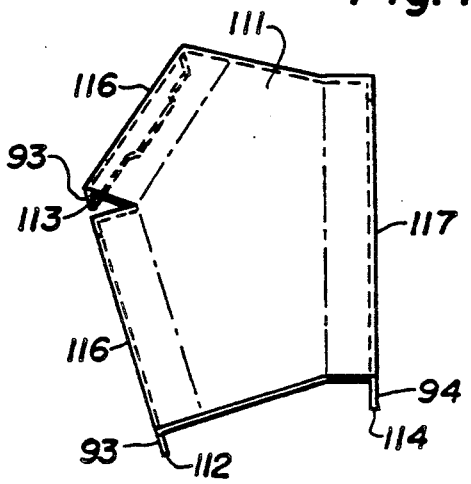
Figure 11:
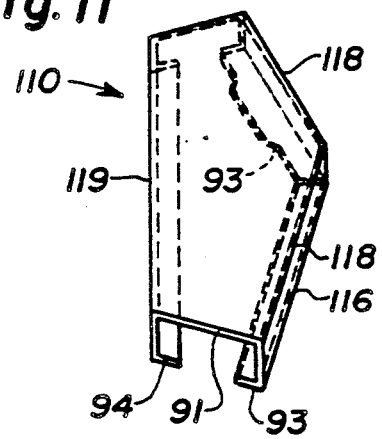
FIGS. 11 and 12 are perspective schematic views of the blanks shown in FIGS. 7–10, depicting a successive step in the method of manufacturing the boom member.
Figure 12:
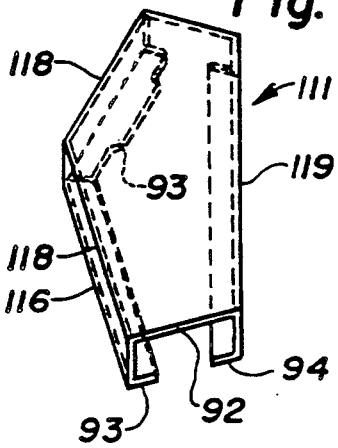

Referring now to FIGS. 7–12, the bending steps of the method of constructing the boom member 45 can best be seen. The blanks 110, 111 are bent along a first bend line 116 and a second bend line 117 to form the legs 93, 94, as depicted in FIGS. 9 and 10. A second bending operation depicted in FIGS. 11 and 12, bending the blanks along third and fourth bend lines 118, 119, places the legs 93, 94 in an inwardly directed configuration forming the C-shaped channel members 91, 92, with the first and second edges 112, 113 oriented in a facing relationship with respect to the corresponding third edge 114.

Figure 13:
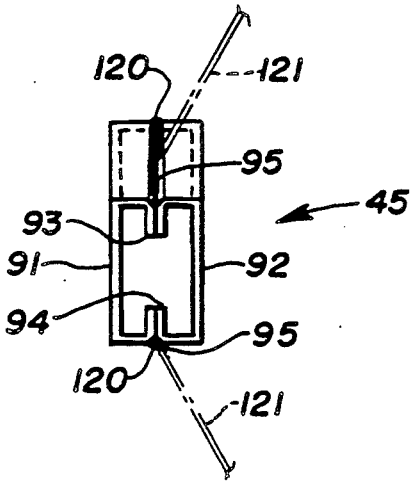
FIG. 13 is a perspective schematic view of the boom member depicting the two halves corresponding to the blanks shown in FIGS. 7–12 being welded together to form part of the boom member, the welding rods being diagrammatically shown.

As depicted in FIG. 13, the two channel members 91, 92 are placed in an opposingly facing orientation with the respective legs 93, 94 adjacent each other and then welded. The weld beads 120 placed by the representative weld rods 121 are located in the upper and lower longitudinal seams 95 formed as grooves due to the bending processes along the respective bend lines 118 and 119. One skilled in the art will readily realize that the welding along the longitudinal seams 95 will facilitate the welding process and provide a uniform groove into which the weld beads 120 are to be located, resulting in a smooth appearance.

Figure 14:
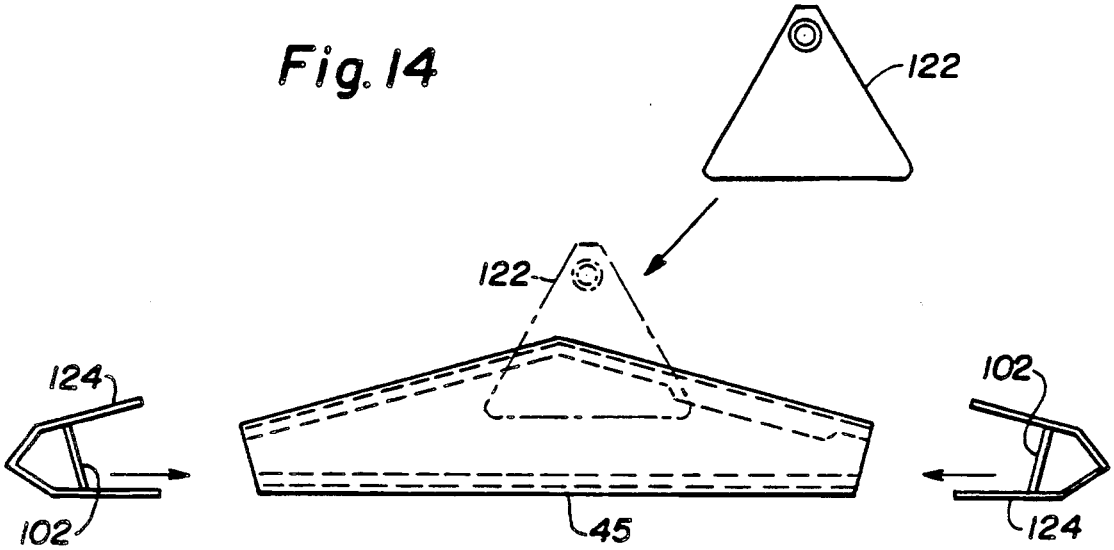
FIG. 14 is a schematic side elevational view of the boom member depicting a successive step in the method of manufacturing the boom member following the step depicted in FIG. 13.
Figure 15:
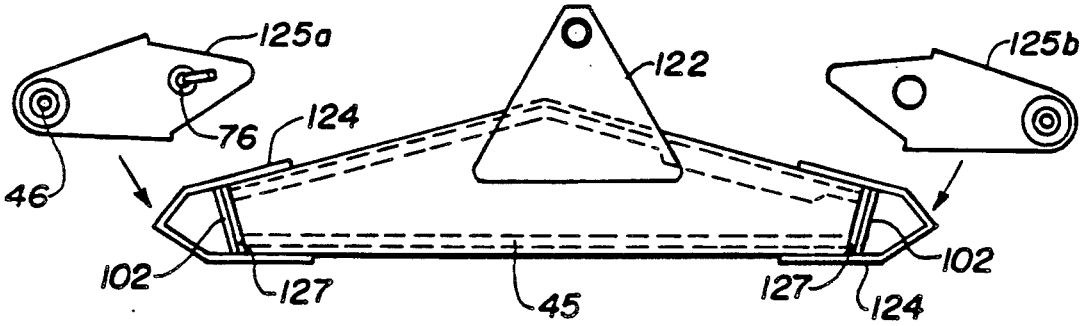
FIG. 15 is a schematic side elevational view of the boom member depicting a successive step in the method of manufacturing the boom member following the step depicted in FIG. 14.
Figure 16:
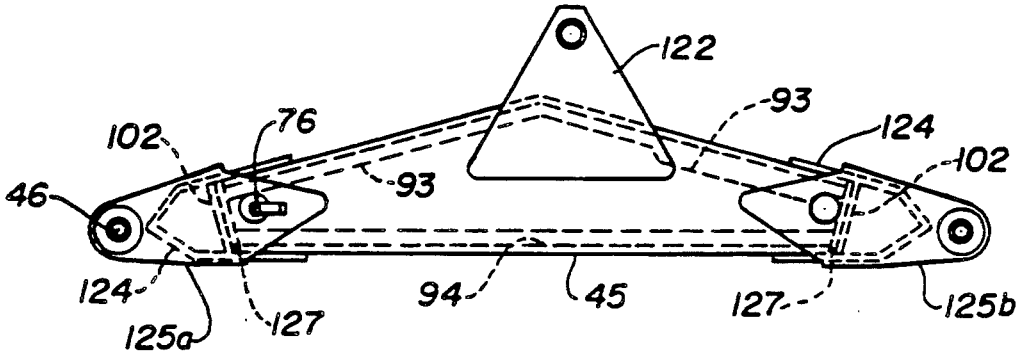
FIG. 16 is a schematic side elevational view of the boom member depicting a successive step in the method of manufacturing the boom member following the step depicted in FIG. 15.

Referring now to FIGS. 14–16, the final steps of the method of manufacturing the boom member 45 can be seen. Once the two channel members 91, 92 have been welded together, the end caps 124 can be welded to the respective ends of the affixed channel members 91, 92. As noted above, the end caps include a shear panel 102 which closes off the respective ends of the channel members 91, 92 to form a closed box beam-like member. A tower 122 is also affixed to the welded channel members 91, 92 to provide a mounting for both the boom cylinder 55 and the dipper cylinder 56, as best seen in FIG. 1.

After affixing the end caps 124 to the cojoined channel members 91, 92, the pivot carriers **125*a*, 125*b* are welded to the respective end caps 124 and the channel members 91, 92. Since the critical dimension for the boom member 45 is the distance between the pivots carried by the pivot carriers 125*a*, 125*b*, the end caps 124 may be welded to the cojoined channel members 91, 92 with a gap 127 between the end cap 124 and the cojoined channel members 91, 92. As noted above, the pivot carrier 125*a* closest to the mounting member 42 is provided with pins 76 to be engageable with the hook members 75 of the transport lock 70**.

Figure 17:
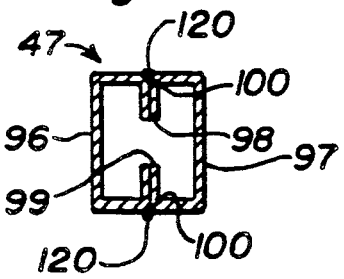
FIG. 17 is a cross-sectional view of the dipper member corresponding to lines 17—17 of FIG. 1.

Referring now to FIG. 17, one skilled in the art can readily see that the dipper member 47 is constructed in a similar manner to that described above with respect to the boom member 45. The edges of the blanks (not shown) forming the channel members 96, 97 welded together with a weld bead 120 placed in the longitudinal seams 100 between the channel members 96, 97 to form the dipper member 47 are also positioned internally or covered by corresponding end caps and pivot carriers, so that these edges, like the edges 112, 113 and 114 of the boom member 45, need not be finely cut.

It will be understood that changes in the details, materials, steps, and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description may be employed in other embodiments without departing from the scope of the invention. Accordingly, the following claims are intended to protect the invention broadly as well as in the specific form shown.

Having thus described the invention, what is claimed is:

1. In a backhoe having a prime mover including a wheeled frame; and an articulated boom assembly pivotally connected to said frame for movement about a generally vertical axis, said boom assembly having a boom member pivotally supported from said frame for movement in both generally horizontal and generally vertical planes, a dipper member pivotally connected to said boom member for movement in a generally vertical plane relative to said boom member, and a working tool pivotally connected to a distal end of said dipper member and being moveable in a generally vertical plane relative to said dipper member, both said boom member and said dipper member having a longitudinally extending length, said boom assembly including hydraulic cylinders respectively interconnecting said frame and said boom member, said boom member and said dipper member, said dipper member and said working tool and being selectively operable to move said boom assembly about a generally horizontal axis to effect a raising and lowering of said working tool relative to said frame and to effect a articulated movement of said boom assembly to cause a relative movement of said working tool relative to said frame, the improvement comprising:

said boom member being constructed of two channel members having a C-shaped cross-sectional configuration forming horizontally disposed halves of said boom member, each said channel member having opposing upper and lower inwardly extending legs which are affixed to the corresponding extending legs of the opposing channel member to form said boom member, such that the cross-sectional configuration of said boom member includes the opposing centrally located, inwardly directed, cojoined legs of the opposing channel members, each said pair of cojoined legs extending inwardly from a corresponding outer surface of said boom member for a depth therefrom, said depth of at least one of said inwardly directed cojoined legs varying along the longitudinal length of said boom member.

2. The backhoe of claim 1 wherein said cojoined channel members form a longitudinally extending seam, said channel members being affixed by welding along said seam.

3. The backhoe of claim 1 wherein said dipper member is constructed or two channel members having a C-shaped cross-sectional configuration forming horizontally disposed halves of said dipper member, each said channel member having upper and lower inwardly extending legs which are affixed to the corresponding extending legs of the opposing channel member to form said dipper member, such that the cross-sectional configuration of said dipper member includes the centrally located, inwardly directed, cojoined legs of the opposing channel members.

4. The backhoe of claim 3 wherein said cojoined channel members of said dipper member form a longitudinally extending seam, said dipper member channel members being affixed by welding along said seam.

5. The backhoe of claim 3 wherein both said boom member and said dipper member have shear panels welded to the ends of the corresponding channel members.

6. The backhoe of claim 3 wherein the depth of at least one of said inwardly directed cojoined legs of said dipper member varies along the longitudinal length of said dipper member.

* * * * *